US005713155A

United States Patent [19]

Prestele

[11] Patent Number: 5,713,155

[45] Date of Patent: Feb. 3, 1998

[54] GRID PLATE FOR STABILIZING NATURAL GROUND

[75] Inventor: Eugen Prestele, Augsburg, Germany

[73] Assignee: Alexander Kienle, Augsburg, Germany

[21] Appl. No.: 554,346

[22] Filed: Nov. 6, 1995

[30] Foreign Application Priority Data

Nov. 7, 1994 [DE] Germany ..... 9417815 U

[51] Int. Cl.[6] ..... A01G 9/02; E01C 5/20

[52] U.S. Cl. ..... 47/33; 47/83; 404/36; 405/258; 405/16

[58] Field of Search ..... 405/258, 15, 16, 405/19; 404/36, 70, 41; 47/33, 83; 52/660

[56] References Cited

U.S. PATENT DOCUMENTS

| | | | |
|---|---|---|---|
| 3,096,621 | 7/1963 | Danel | 405/16 |
| 3,802,144 | 4/1974 | Spica | 404/41 X |
| 4,111,585 | 9/1978 | Mascaro | 404/36 X |
| 4,172,680 | 10/1979 | Brown | 405/16 |
| 4,621,942 | 11/1986 | Hill | 404/36 X |
| 4,671,699 | 6/1987 | Roach | 404/36 X |
| 5,160,215 | 11/1992 | Jensen | 405/16 X |
| 5,287,649 | 2/1994 | Prestele | 404/36 X |
| 5,467,554 | 11/1995 | Prestele | 404/36 X |

FOREIGN PATENT DOCUMENTS

| | | | |
|---|---|---|---|
| 3722426 | 1/1989 | Germany | 405/16 |
| 516957 | 4/1992 | Germany . | |
| 4117293 | 12/1992 | Germany | 405/258 |
| 126825 | 7/1984 | Japan | 405/16 |
| 315732 | 12/1988 | Japan | 405/16 |
| 446416 | 3/1968 | Switzerland | 404/41 |
| 720095 | 3/1980 | U.S.S.R. | 405/16 |

*Primary Examiner*—Tamara L. Graysay
*Assistant Examiner*—Frederick L. Lagman
*Attorney, Agent, or Firm*—Antonelli, Terry, Stout, Kraus, LLP

[57] ABSTRACT

A grid plate for stabilizing natural ground comprises a base and side walls formed in one piece with the base which form chambers open to the top being in the form of regular polygons, the base having water outlets, the chambers being in the form of sectional chambers which are laterally open on their periphery which form closed chambers with laterally open sectional chambers of adjacent grid plates complementary thereto when two similar grid plates are assembled and the ends of side walls of both grid plates forming the sectional chambers come into contact, the side walls having flattenings in the regions of contact, the flattenings of complementary chambers lying flat on one another when two similar grid plates are joined together.

7 Claims, 3 Drawing Sheets

GRID PLATE FOR STABILIZING NATURAL GROUND

FIELD OF INVENTION

This invention relates to a grid plate used for stabilizing natural ground.

BACKGROUND OF THE INVENTION

A grid plate of the type described herein is described in patent publication EP 516 957 A1. According to the publication, a grid plate of this type is used for stabilizing natural ground to assist in seeding surfaces. For this purpose, the grid plate has a base and side walls formed in one piece, which form chambers open toward the top in the form of regular polygons. Regular hexagons are preferred, although other shapes, e.g. squares, can also be used.

The base contains water outlets. Moreover, on the edges, but at least on one edge of the grid plate, the base has projections for engaging with a corresponding edge of an adjacent similar grid plate. A number of flat grid plates joined to one another thus form a surface for natural ground which stabilizes the earth and can be travelled on. Earth can be filled into the chambers and seeded, whereby the grass roots become rooted to the subsoil via the water outlets.

In the grid plate described in the aforementined publication, the chambers are formed, on their peripheral side, as sectional chambers open toward the side which, when two similar grid plates are joined together, form closed chambers by means of corresponding peripheral sectional chambers of adjacent grid plates which are also open on the side and are complementary thereto. In this case, the side walls of both grid plates forming these sectional chambers only come in contact along their vertical abutting edges. The disadvantage of this, with respect to the grid plates which have been known for a longer time and in which the peripheral chambers are also closed, is that the edges of adjacent grid plates do not mate over a large area and thus earth or stones flowing into these interspaces prevent proper laying of grid plates.

The grid plate described in the cited publication has the disadvantage of a peripheral area which can only be slightly loaded, compared to the inside area of the grid plate. The reason for this is that the interlocking of two adjacent grid plates only takes place via the horizontal tongues of the base part which reciprocally grip under the respective adjacent plate, as a result of which all of the lateral forces and compressive forces at certain points in the peripheral area can only be absorbed by these tongues or projections. When there is a very large load, e.g. when a truck travels over the grid plate, this can result in the projections of the base breaking.

SUMMARY OF THE INVENTION

Thus, it is an object of the invention to provide a grid plate of this type so that it exhibits a clearly increased stability for absorbing lateral forces and selective compressive forces in the peripheral areas.

In accordance with an embodiment of the invention, a grid plate for stabilizing natural ground, comprises a base and side walls formed in one piece with the base which form chambers open to the top being in the form of regular polygons, the base having water outlets, the chambers being in the form of sectional chambers which are laterally open on their periphery which form closed chambers with laterally open sectional chambers of adjacent grid plates complementary thereto when two similar grid plates are assembled and the ends of side walls of both grid plates forming the sectional chambers come into contact, the side walls having flattenings in the regions of contact, the flattenings of complementary chambers lying flat on one another when two similar grid plates are joined together.

BRIEF DESCRIPTION OF THE DRAWINGS

Embodiments of the invention will be describe ed in greater detail below with reference to the accompanying drawings, in which.

DETAILED DESCRIPTION OF THE PREFERRED EMBODIMENTS

Figure 1:
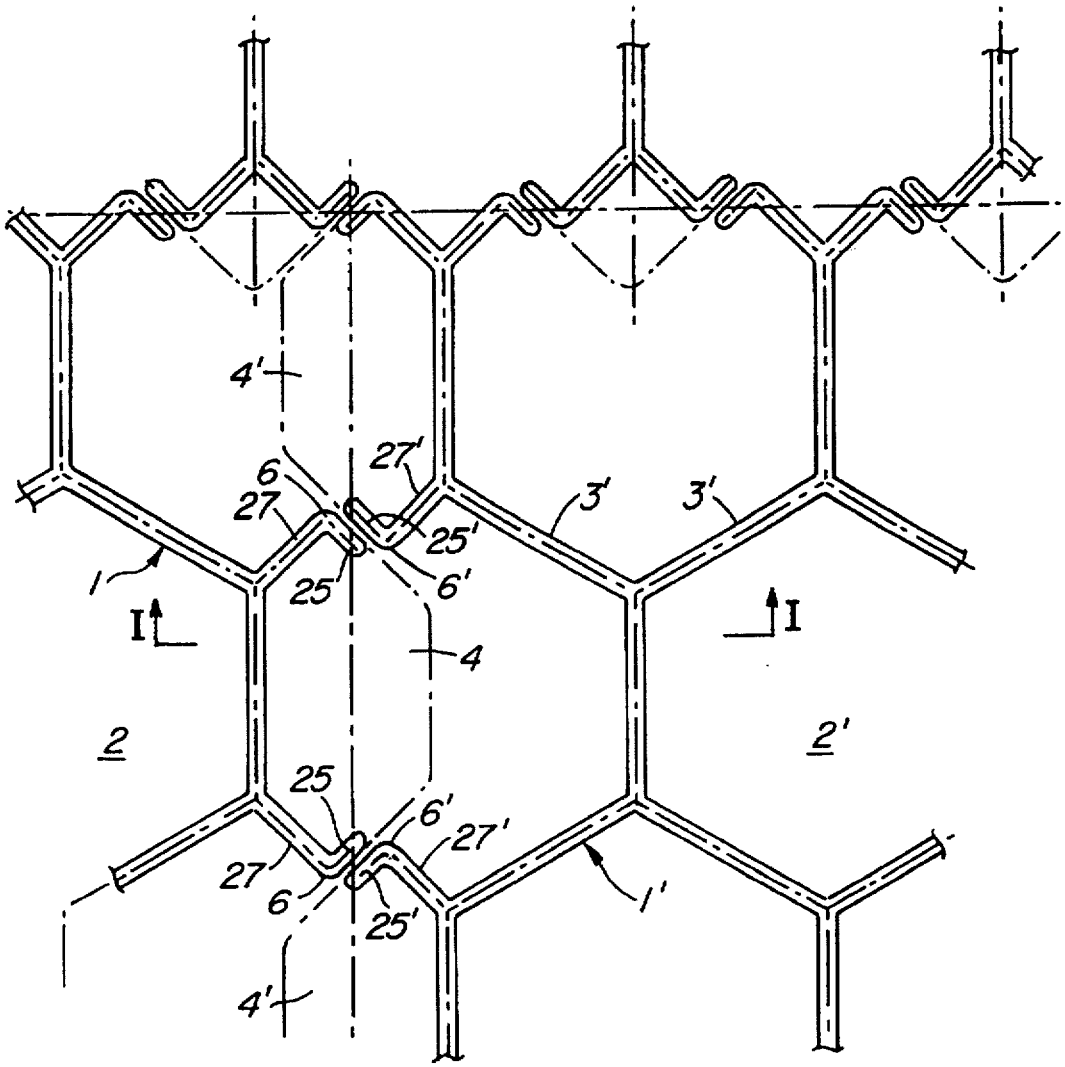
FIG. 1 is a top view of the peripheral area of three adjacent grid plates according to a first embodiment of the invention.

In FIG. 1, a grid plate 1 is shown on the left and a grid plate 1' on the right. A third grid plate at the top is not designated by reference numeral. Each of grid plates 1 and 1' has a base 2 or 2' comprising water outlets (not shown). The interior areas of both grid plates are designated in a conventional manner, i.e. side walls 3 or 3' are formed with the base 2 or 2', which form chambers in the shape of regular hexagons open toward the top.

Figure 4:
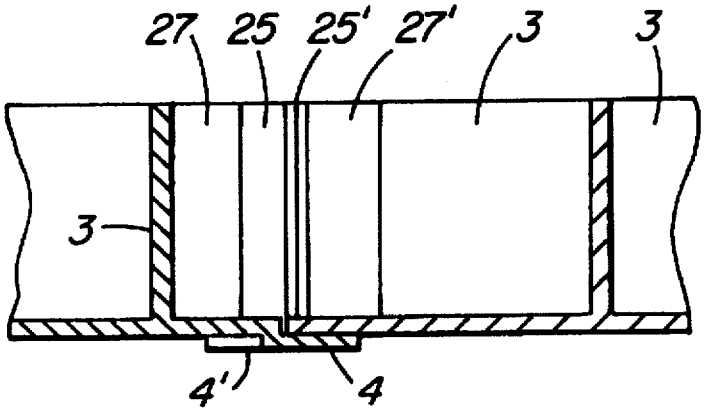
FIG. 4 is a cross section of FIG. 1 on the line I—I.

The edges of both grid plates 1 and 1' (shown by a broken line) have projections 4 and 4' respectively of a known form, whereby a projection is allotted to about every second peripheral chamber. The projections 4 and 4' grip reciprocally under the base 2' or 2 of the respective adjacent grid plate 1' or 1, as shown in FIG. 4. Also in a known manner, the chambers are formed with laterally open sectional chambers on the periphery, whereby sectional chambers with four corners or two corners of the hexagon are alternately formed. When two similar grid plates are assembled, these sectional chambers form closed chambers due to the laterally open, complementary peripheral sectional chambers of the adjacent grid plate (1, 1') which alternate in the same way.

In the present invention, however, they do not have the exact shape of a hexagon but only approximate that shape, which will be described below.

While in the prior art grid plates, the butt edges of the open side walls 27 or 27' come into contact essentially only in a linear manner, that is, they form an almost ideal hexagonal chamber when the respective sectional chambers are connected, there are no butt edges in the present case. Instead the side walls 27 or 27' are provided with flattenings 25 or 25' which lie flat on top of one another when the grid plates 1 or 1' are joined together.

It can be seen in FIG. 1, in the embodiment shown there, that the flattenings 25, 25' are formed by almost right angle bends 6 or 6' of the side wall 27 or 27' of the two grid plates 1 or 1' into the shape of an L. Since the flattenings 25, 25' are made by bends 6 or 6' in the same directional sense and the flattenings 25, 25' are to lie flat on top of one another according to the embodiment of the invention, the mating side walls 27 and 27' with the adjacent side walls 3 of the same sectional chamber should form an angle which deviates from the corner angle of a regular hexagon (120°). In this case, the corner angle to the adjacent side wall 3 is enlarged in the one side wall 27, and in the other side wall 27', this corner angle is somewhat reduced. Consequently, the flattenings 25, 25' of both side walls 27 or 27' can lie flat on top of one another.

Figure 5:
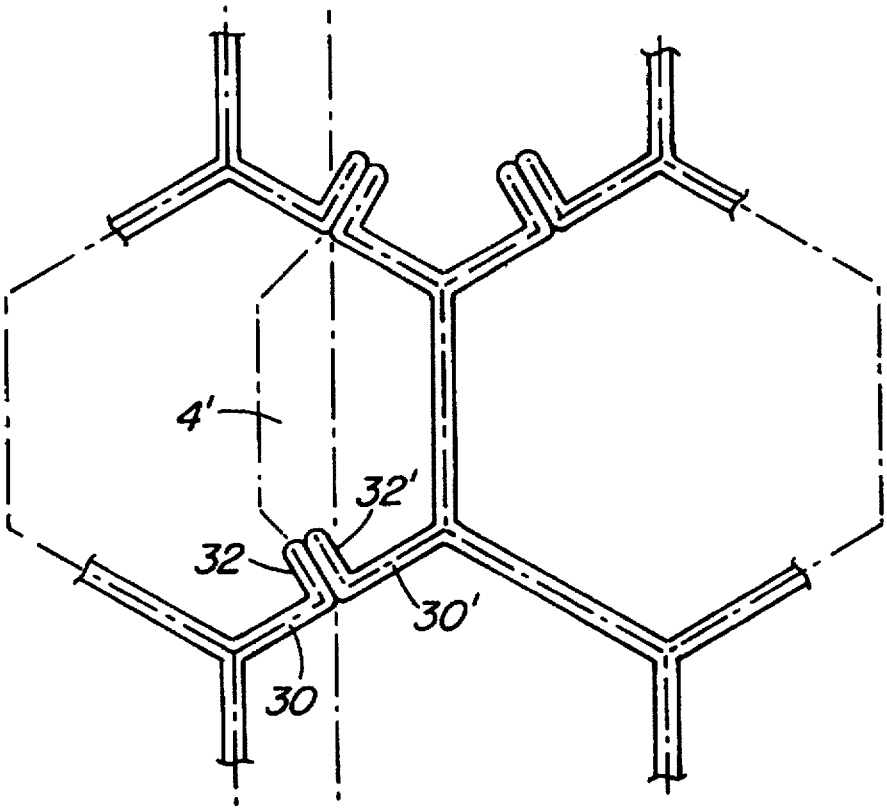
FIG. 5 is a top view of the peripheral area of two adjacent grid plates according to a fourth embodiment of the invention.

In an alternative embodiment as shown in FIG. 5, the bends 32, 32' of two complementary side walls 30, 30' each of adjacent grid plates are constructed in different directional senses. In this embodiment, the angles of the corresponding side walls remain constant at 120° (in the hexagon) with respect to the adjacent side walls of the same sectional chamber.

Figure 2:
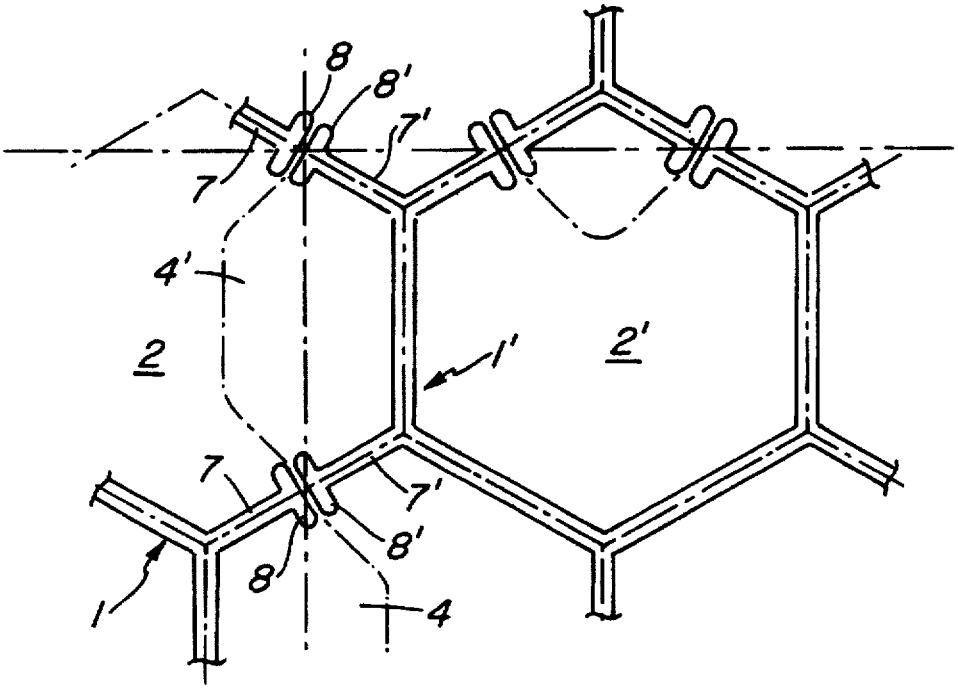
FIG. 2 is a top view of the peripheral area of three adjacent grid plates according to a second embodiment of the invention.

A second embodiment of the invention is shown in FIG. 2. In the upper part of FIG. 2, the side walls 7 and 7' have face walls 8 and 8' respectively at right angles thereto, forming T shapes with the side walls 7, 7'. The corner angles within the complementary peripheral hexagon remain at 120°.

Figure 3:
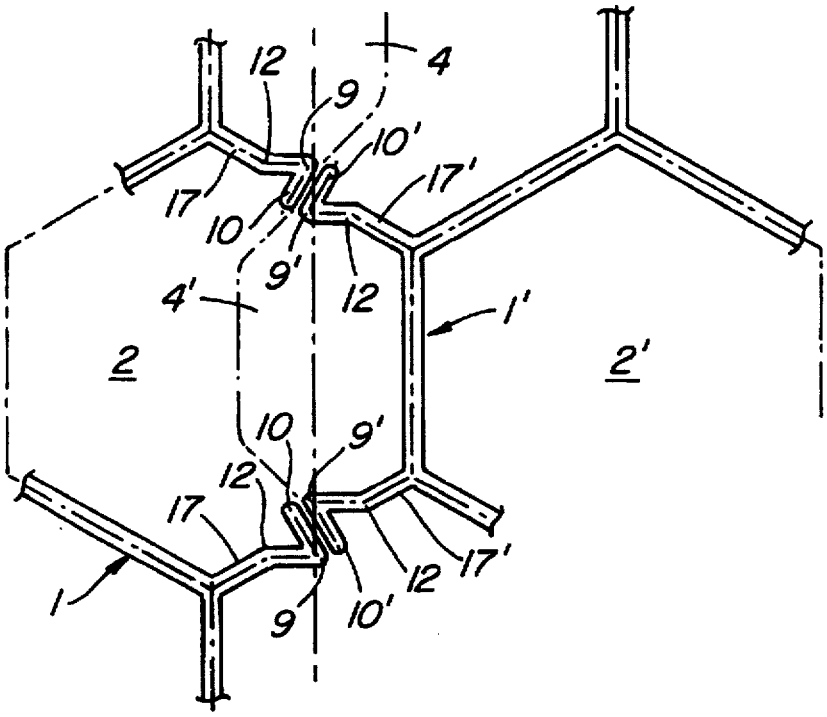
FIG. 3 is a top view of the peripheral area of two adjacent grid plates according to a third embodiment of the invention.

In a further embodiment shown in FIG. 3, the complementary side walls 17 and 17' are provided with acute-angled bends 9 and 9' respectively and have obtuse-angled opposing bends 12 and 12' to these acute-angled bends 9 and 9' in their runs to the mating corners of the hexagon. This results in the illustrated hook-like shape of each side wall 17 and 17' and the flattenings 10 and 10' lying flat on top of one another.

All four embodiments have in common that the ends of the side walls e.g. 7, 7', 17, 17' or 27 and 27' forming the sectional chambers do not come in contact in a linear manner, contrary to the known grid plates. Instead they lie flat against one another due to the flattenings in the assembled state of two similar grid plates 1 and 1'.

This results in significant advantages in stabilizing the ground covering formed by these grid plates in the peripheral region of the grid plates. When there is selective loading in the peripheral area, the shearing force on the projections of the base 4 is considerably reduced, since a great part of this force is absorbed by the flattenings of the side walls lying flat on top of one another. The same is true for laterally acting forces when, for example, the wheels of a vehicle standing on the ground covering are driven since the flattenings also act in a cant-like and stabilizing manner.

In addition, the additional flattenings are so small, compared to the grid plates having the closed peripheral chambers, that the danger of soil and stones sliding in during laying is only very slight. Thus, both a quick and uncomplicated laying and high stability are assured with the grid plate of the invention.

I claim:

1. A grid plate for stabilizing natural ground, comprising a base and side walls formed in one piece with the base which form chambers open to the top being in the form of regular polygons, the base having water outlets, the chambers being in the form of sectional chambers which are laterally open on their periphery which form closed chambers with laterally open sectional chambers of adjacent grid plates complementary thereto when two similar grid plates are assembled and the ends of the side walls of both grid plates forming the sectional chambers come into contact, the ends of the contacting side walls having flattenings in the region of contact formed as bends at the ends of the side walls, the bends at the ends of two complementary side walls lying flat against each other when two similar grid plates are joined together.

2. A grid plate as defined in claim 1, further including projections from at least one edge thereof, for engaging with the edge of a base of an adjacent similar grid plate.

3. A grid plate as defined in claim 2, wherein each flattening is formed as a right angle bend at the end of a side wall, into the shape of an L.

4. A grid plate as defined in claim 3, wherein the bends of two complementary side walls of adjacent grid plates have the bend formed in a different direction.

5. A grid plate as defined in claim 3, wherein the bends of two complementary side walls of adjacent grid plates have the same direction of bend, and the complementary side walls are each at an angle deviating from a corner angle of the regular polygon with an adjacent side wall of the same seotional chamber, whereby the flattenings can lie flat against one another.

6. A grid plate as defined in claim 1, wherein each flattening of the side wall ends of adjacent grid plates is formed with a face wall standing at right angles to the end of the adjoining side wall and forming a T-shape.

7. A grid plate as defined in claim 1, wherein each flattening of adjacent grid plate side wall ends is formed as an acute angled bend of each adjoining side wall which has an obtuse angled opposing bend in its run from a mating corner of a polygon shaped chamber to the acute angled bend.

* * * * *